United States Patent [19]

Kaluza

[11] Patent Number: 4,493,496

[45] Date of Patent: Jan. 15, 1985

[54] CONTINUOUS FORM MULTIPLE PLY ASSEMBLY

[76] Inventor: Rudolph T. Kaluza, 15650 E. Eldorado Dr., Aurora, Colo. 80013

[21] Appl. No.: 504,332

[22] Filed: Jun. 14, 1983

[51] Int. Cl.[3] ..... B41L 3/00; G09F 3/02; B42D 15/00

[52] U.S. Cl. ..... 282/11.5 A; 229/69; 282/9 R; 282/11; 282/16 R

[58] Field of Search ..... 229/69; 282/8 R, 9 R, 282/10, 11, 11.5 A, 11.5 R, 12 R, 12 A, 13, 14, 15 R, 15 B, 16 R, 16 B, 20 R, 20 B, 21 R, 21 C, 21 D; 281/31

[56] References Cited

U.S. PATENT DOCUMENTS 3,947,983 4/1976 Brunette ..... 282/11.5 A X
4,002,356 1/1977 Weidmann ..... 282/8 R X

FOREIGN PATENT DOCUMENTS 2043534 8/1980 United Kingdom ..... 282/8 R

*Primary Examiner*—Paul A. Bell

[57] ABSTRACT

This multiple ply assembly yields individual invoice/itinerary sheets and a traveler's ticket-holding folder with the invoice/itinerary information printed directly on the flap. Invoice/itinerary information entered on the outer ply is printed on the area corresponding in size and orientation on all plies. When this corresponding portion of the next to last ply is detached, yielding an additional invoice/itinerary sheet, the remainder of the next to last ply forms a pocket on one corner of the last ply by means of adhesive. The portion of the last ply corresponding in size and orientation to the outer ply forms the flap of a ticket-holding folder, of which the aforementioned pocket is a part.

4 Claims, 6 Drawing Figures

FIG. 1
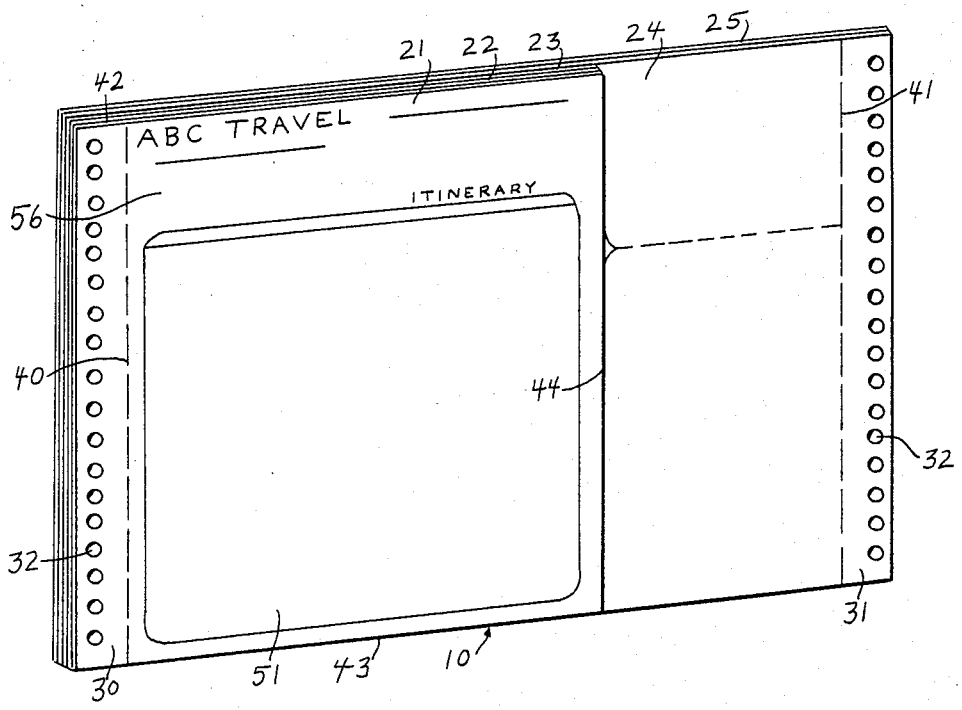
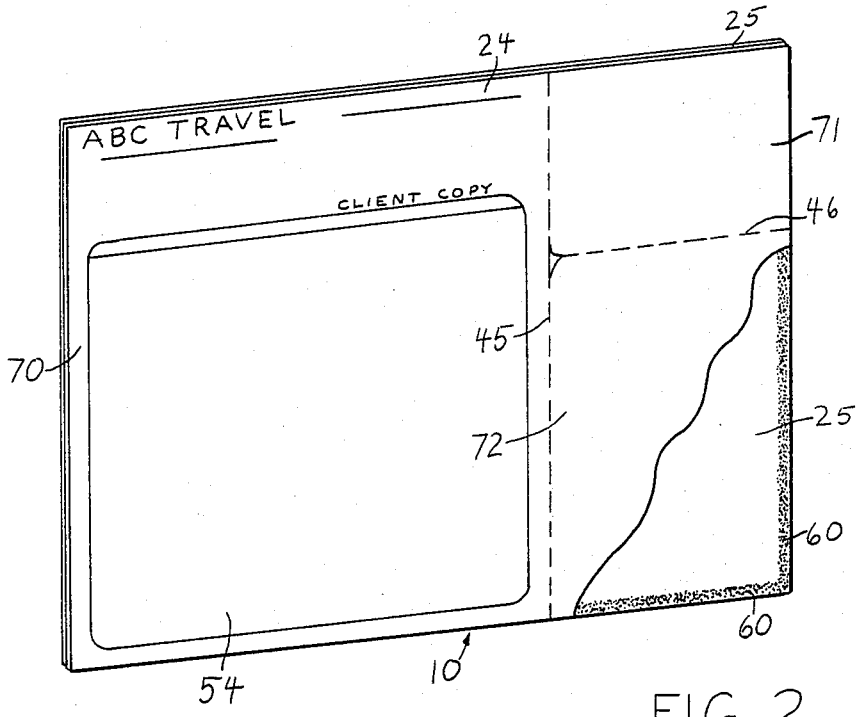
FIG. 2

FIG. 3
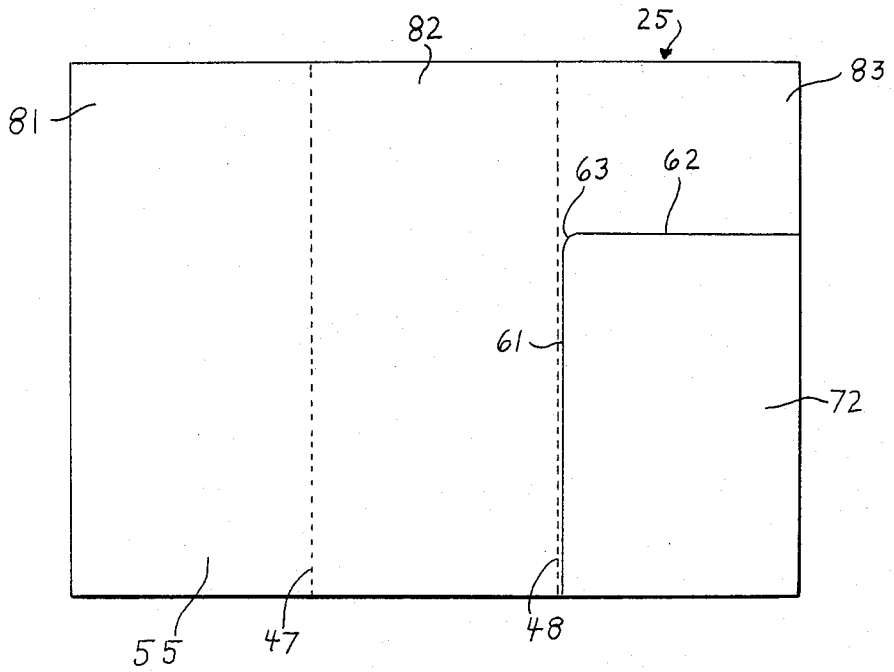
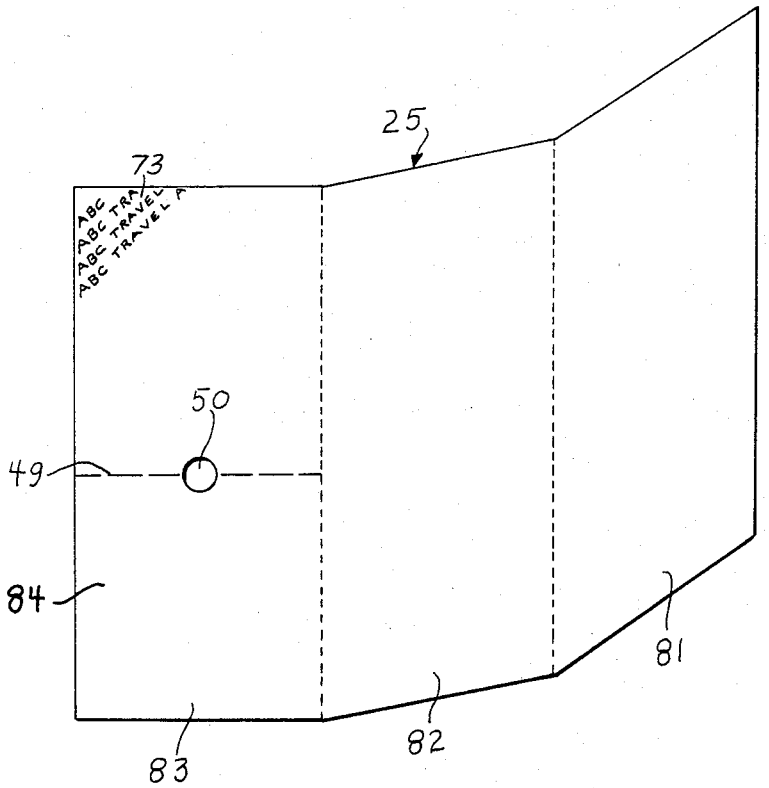
FIG. 4

CONTINUOUS FORM MULTIPLE PLY ASSEMBLY

TECHNICAL FIELD

This invention relates to a continuous form multiple ply assembly, and, more particularly, to such as assembly which consists of invoice/itinerary sheets and a fold-over ticket holding folder.

BACKGROUND ART

Travel agents, airline personnel and persons in similar jobs, having planned and/or booked an itinerary for a customer, often provide the customer with a handy ticket-sized folder to keep tickets, boarding passes, baggage claim checks and the like together in one convenient package. Many travel agents use folders provided by airlines or other carriers or buy similar folders printed with their own company identification.

Although tickets generally set forth flight times, and places of deparature and arrival, a traveler's itinerary may be quite lengthy and also may include car rentals, hotel accomodations, sightseeing tours and the like, all of which may be arranged for the traveler by a travel agent.

Many travel agents, of course, provide their customers with a listing of the various arrangements made. Such a list may be kept by the traveler in any number of places, including the folder provided for his tickets. Most people are careful and alert about where they keep their ticket-holding folder, and, thus, it is an ideal place to keep an itinerary listing, but if an itinerary sheet is kept loose in the folder, along with tickets, boarding passes, baggage claim checks and the like, the itinerary sheet may be inconveniently in the way or, when taken out for consulting, may be lost or temporarily misplaced. If an itinerary listing is kept elsewhere, it may be lost or temporarily misplaced or be buried in luggage when needed. Sometimes an agent will staple a copy of the itinerary sheet to the inside of the flap of the ticket-holding folder. This is one more operation to be performed, and again, the itinerary sheet may be in the way and may have to be lifted out of the way to gain access to tickets. In addition, time may be of the essence in a travel situation, and waiting for an agent to staple something to your ticket folder if you're running to catch a plane could be aggravating and costly.

DISCLOSURE OF THE INVENTION

Accordingly, it is an object of this invention to provide a traveler with a ticket-holding folder on which his itinerary is directly printed.

Another object of the invention is to provide travel agents and the like with an attractive service for their customers without extra work or wasting time, such as by printing the itinerary twice or manually attaching a sheet to a ticket folder.

Another object of the invention is to provide travel agents and the likke with invoice/itinerary sheets and ticket-holding folders in one convenient assembly.

Another object of the invention is to provide travel agents and the like with a customized product which may be constructed to produce any reasonable number of copies of the invoice/itinerary, and in sizes which will accomodate various computer software programs.

Another object of the invention is to provide travel agents with a ticket-holding folder which will carry their company's identifying marks and slogans.

Another object of the invention is to provide an invoice/itinerary and ticket-holding folder assembly on which information can be printed by hand, by typewriter, or by computer printer.

Another objective of the invention is to allow the printing of a single invoice/itinerary on a computer printer or typewriter and its immediate extraction from the continuous roll or fanfold, leaving the margins connected in a continuous fashion, which allows for the continuous feed and printing of the following invoice/itinerary upon demand. There is no loss of a blank invoice/itinerary due to extraction and no need for rethreading in order to print the next invoice/itinerary.

Briefly, these and other objects of the invention are accomplished by means of a multiple ply continuous form assembly. The assembly includes control margins with line holes for stepping through a computer printer and line perforations for removal of the control margins. Line perforations are also provided for separation of each individual multiple ply assembly from those coming before and after in the continuous roll or fanfold.

A typical embodiment of the invention includes five plies. The three plies on one side of the product, ply one, two, and three, are captured in the control margin all along the same longitudinal edge and extend across only approximately two-thirds of the lateral width of the assembly. The other longitudinal edge of plies one, two, and three are free. Plies four and five, of which the fifth ply comprises the opposite surface of the assembly, are captured in both control margins and their lateral width equals the full lateral width of the entire assembly.

Plies one, two, and three, and the area of plies four and five which lie directly behind plies one, two and three bear graphic designs indicating that they are invoice/itinerary sheets. The assembly is constructed of carbonless, self encapsulated paper of which "NCR paper" is typical. Thus, the invoice/itinerary information entered on ply one will appear on all five plies.

When the control margin in which plies one, two, three, four, and five are capatured is detached, this completely separates plies one, two, and three into individual sheets which may serve as an original, a travel agency copy, and a customer billing copy of the invoice/itinerary. Alternatively, if desired, lines of adhesive may attach plies one, two, and three to each other for ease of handling after detachment.

The portion of ply four which corresponds in size and orientation to plies one, two, and three is detachable from the rest of ply four by means of line perforations, and serves as a fourth copy of the invoice/itinerary sheet. After this sheet is detached from ply four and the other control margin is detached from plies four and five, the remainder of ply four and ply five are still connected to each other, by means of a peripheral line of adhesive around the common overlaying corner. The adhesive extends approximately one-third of the lateral width of ply five (the full width of the corresponding portion of ply four that overlays ply five) and approximately two-thirds of the longitudinal extent of both of the fourth and fifth overlaying plies, in order to form a pocket. There is a line perforation for detaching the small portion of ply four which lies beyond the longitudinal adhesive line.

After detaching the invoice/itinerary section of ply four and small portion of ply four, what remains is ply five with a pocket formed by a portion of ply four peripherally glued thereto. Ply five is divided into three longitudinal panels separated by weakening lines, on two of which panels the invoice/itinerary information is printed. The pocket is formed on the third panel.

When the three longitudinal panels are folded over along the weakening lines, a ticket-holding folder is constructed, on the inside of the flap of which the itinerary is printed.

The features and advantages of the invention are expressed in more complete detail in the following description of a specific embodiment of the invention. The scope of the invention, however, is limited only by the claims.

BRIEF DESCRIPTION OF THE DRAWINGS

FIG. 1 is a top, perspective view of a multiple ply assembly embodying principles of the invention;

FIG. 2 is a top, perspective view of the next to last and last plies of the assembly shown in FIG. 1;

FIG. 3 is a top view of the last ply, and a portion of the next to last ply;

FIG. 4 is a top, perspective view of the reverse side of the last ply;

DETAILED DESCRIPTION OF THE PREFERRED EMBODIMENT

Figure 5:
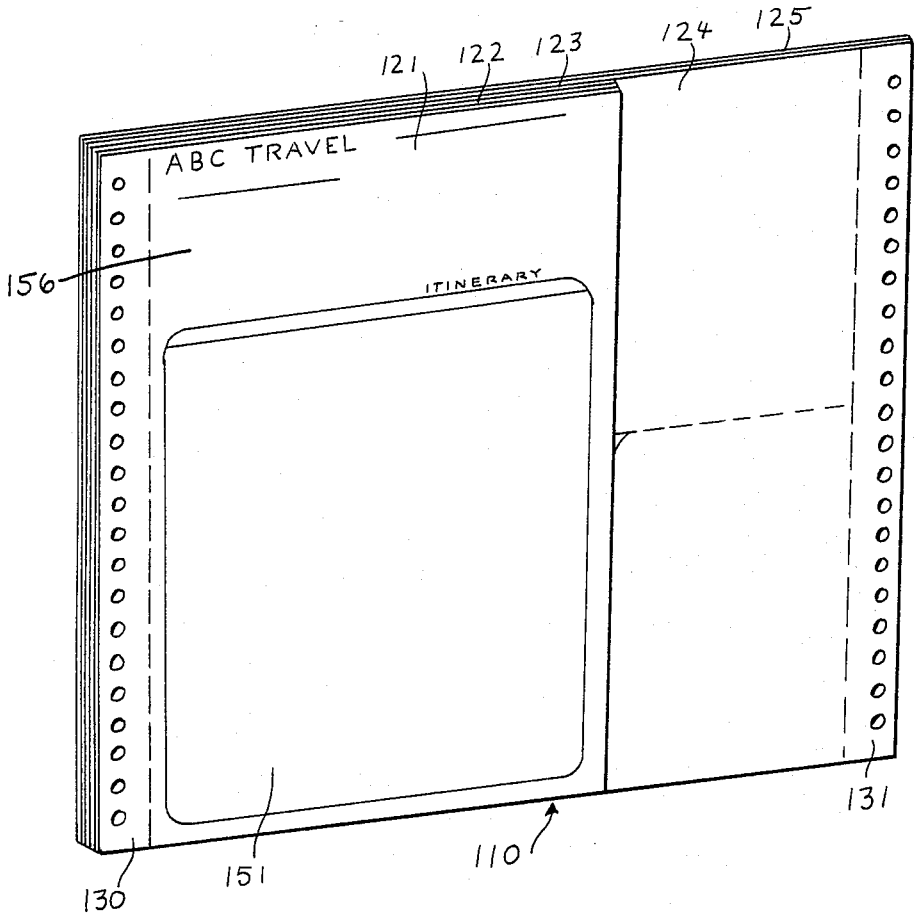
FIG. 5 is a top perspective view of an alternate embodiment of the invention.

For a more thorough understanding of the invention, attention is invited to FIG. 1, which shows a five-ply assembly 10. The top ply 21, second ply 22, third ply 23, fourth ply 24, and fifth ply 25 are all captured in control margin 30 and detachable therefrom by means of line perforations 40. Only the fourth ply 24 and the fifth ply 25 are captured in control margin 31, and are detachable therefrom by means of line perforations 41. The control margins 30 and 31 (fastened together by means of paper crimps) contain line holes 32 for stepping the form assembly 10 through a computer printer (not shown).

Lateral edges 42 and 43 of all five plies, 21, 22, 23, 24, and 25, are detachably connected to the corresponding plies of the assemblies (not shown) which come before and after the assembly 10 on a continuous roll or fan fold by line perforations.* *These line perforations have more ties at the margins 30 and 31 to hold the margins together more securely while the line perforations for the body of the assembly 10, less the margins 30 and 31, have fewer ties for easier separation. Longitudinal edges 44 of the top ply 21, the second ply 22, and the third ply 23, are free. Thus, when assembly 10 is detached from the neighboring assemblies on the continuous roll or fanfold of forms and when control margin 30 is removed, the top ply 21, second ply 22, and third ply 23, become separate free sheets.

Area 51 on the top ply 21 is designated by graphic design means as an area for receiving invoice/itinerary information. The corresponding areas on the second ply 22 (not shown), third ply 23 (not shown), fourth ply 24 (54 in FIG. 2), and fifth ply 25 (55 in FIG. 3), which lie directly behind area 51 are also designated spaces for receiving invoice/itinerary information. The information typed or printed on the top ply 21 will also print on the corresponding areas of the other four plies due to the assembly being constructed of carbonless, self encapsulted paper of which "NCR paper" is typical.) The top ply 21 is CB (coated back) paper, the second, third and fourth plies, 22, 23, 24 are CFB (coated front and back) paper, and the fifth ply 25 is CF (coated front) paper. The top three plies 21, 22, and 23, may be constructed of a lightweight paper such as 14 or 15 lb. paper, the fourth ply 24 may be constructed of a heavier paper, such as 22 lb. paper, and the fifth ply 25 may be constructed of still heavier paper, such as 27 lb. paper.

Attention is invited to FIG. 2, which shows the fourth ply 24 and fifth ply 25 after the removal of control margins 30 and 31 and after the removal of the top ply 21, the secon ply 22, and the third ply 23 (not shown in FIG. 2). The fourth ply 24 and the fifth ply 25 are now connected only by means of lines of adhesive 60 between the fourth ply 24 and the fifth ply 25.

Section 70 of the fourth ply 24 is approximately equal in length and width to the top three plies 21, 22, and 23. Area 54 corresponds to area 51 (FIG. 1) on top ply 21 and receives the same itinerary information entered on the top ply 21 in area 51. Section 70 is detachable from the rest of the fourth ply 24 by means of line perforations 45. Section 71 of the fourth ply 24 is detachable from the rest of the fourth ply 24, section 72, by means of line perforations 46 extending laterally between sections 71 and 72.

Attention is now invited to FIG. 3, which shows the fifth ply 25 and section 72 of the fourth ply 24 peripherally glued thereto. Edges 61 and 62 of section 72 are free. Area 63 of section 72 is rounded for ease of handling and for appearance.

Longitudinal extending weakening lines 47 and 48 divide the fifth ply 25 into three panels, 81, 82, and 83, which panels are of approximately equal lateral width. Panels 82 and 83 may be of equal width while panel 81 is slightly narrower, or alternatively, panels 81 and 83 may be slightly narrower than panel 82. In the first mentioned embodiment, panel 81 is folded over panel 82 and both panels 81 and 82 then are folded across the face of panel 83 to form a ticket-holding folder. In the alternative embodiment, the ticket-holding folder may also be formed by folding panel 82 over panel 83 and wrapping panel 81 around.

As area 55, covering panels 81 and 82 corresponds to area 51 (FIG. 1) on the top ply 21, the invoice/itinerary information entered in area 51 appears in area 55 as well. Thus, the itinerary is printed on the flap of the ticket-holding folder.

Attention is invited to FIG. 4, showing the reverse side of the fifth ply 25. In order to provide a conveniently available pocket for holding an airline boarding pass, or ticket line perforations 49 may be torn by inserting a finger in hole 50.* *Line perforations 49 and fingerhole 50 may be replaced with a single line cut, or other suitable opening. The lower portion 84 of the back of panel 83 is thus pulled outward and the boarding pass (not shown) may be inserted in the pocket formed, providing easy access to the pass.

The entire reverse side of the fifth ply 25, which becomes the outside of the ticket-holding folder, may be custom printed with repeating lines of a travel agency's or airline's name or logo (or any other desired design), such as partially drawn in FIG. 4 and identified by numeral 73. A similar repeating motif may also appear on section 72 (FIG. 3) or anywhere else on the folder.

The embodiment of the invention designated assembly 10 and shown in FIGS. 1 through 4, inclusive, is approximately $8\frac{1}{2}''$ long$\times 11\frac{3}{8}''$ wide. It thus yields a ticket-holding folder approximately $8\frac{1}{2}''\times 3\frac{7}{8}''$, an approximate standard size for ticket-holding folders. As the individual itinerary sheets 21, 22, 23, and 70 may serve as billing, invoice, file, airline copies etc. relating to a customer's account, part of the area of the sheet (the upper part 56 in FIG. 1) is of necessity given over to holding necessary account information, such as the name and address of the customer, the account number, and the name and address of the travel agent or airline*

*The area 51 (FIG. 1) for the $8\frac{1}{2}''$ length is appropriate for 7" software programs while the area 151 (FIG. 5) for larger itineraries are compatable with 11" software programs. (The identification numerals in FIGS. 5 and 6 correspond to those in FIGS. 1–4, with the addition of 100.)

Figure 6:
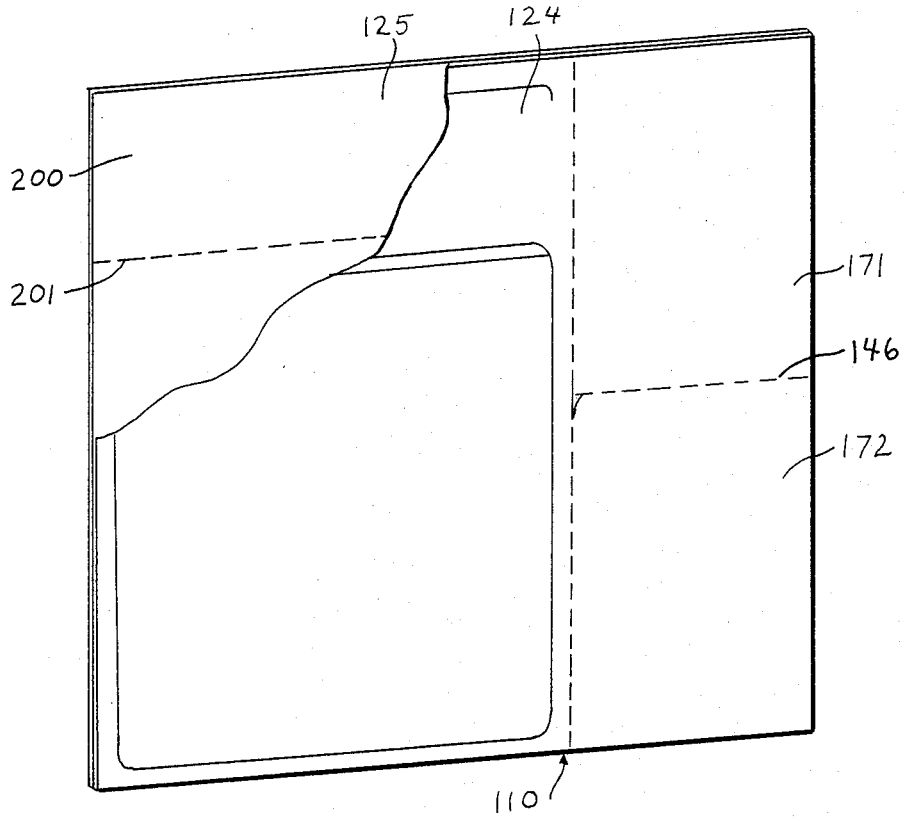
FIG. 6 is a top perspective view of the next to last and last plies of the alternate embodiment shown in FIG. 5.

Turning to FIG. 5, the dimensions of assembly 110 (without control margins 130 and 131) are approximately 11" in length$\times 11\frac{3}{8}''$ in width. The entire area designated 151 (corresponding in size to the entire top ply 21 in FIG. 1) is available in this embodiment for itinerary/invoice information. Such things as customer name and address, account number, etc. may be placed in the area designated 156. Turning to FIG. 6, showing the fourth ply 124 and fifth ply 125, section 171 of the fourth ply 124 is larger than section 71 of the fourth ply 24 shown in FIGS. 1–4. Thus, when section 171 is removed along line perforations 146, the remaining section 172 is equal in size to section 72 (FIG. 3). When the uppermost portion 200 of the fifth ply 125 is removed along line perforations 201 (which extend across the full lateral expanse of the fifth ply 125), the remaining ticket-holding folder is equal in size to that produced by the embodiment shown in FIGS. 1–4.

Although the embodiments of the invention shown and described herein illustrate the sections 72 and 172 (FIGS. 3 and 6) adjacent to the control margins 31 and 131 (FIGS. 1 and 5), these sections 72 and 172 could as easily be joined to the margins on the opposite side of the individual assemblies, if convenient. The number of plies may vary by application. Typically, as many as seven plies might be required for certain applications. Further in this respect, lines of adhesive may attach any two or more of the plies in any particlar assembly; again depending on specific needs and circumstances. Additionally, in instances where original invoices and statements are not required because payment is made at the time of ticket purchase, such as at airline ticket counters, only plies 124 and 125 (FIGS. 5 and 6) will be required.

What I claim is:

1. A multiple-ply assembly comprising an outer ply, an intermediate ply, and a back ply, having control margin strips along opposed longitudinal sides, the said control margin strips of all plies being separable from the remainder of the assembly by perforations, one longitudinal edge of the said outer ply being captured in one said control margin strip, the said outer ply extending partially across the lateral width of the assembly; both longitudinal edges of the said intermediate and back plies being caught in said control margin strips, the portion of the said intermediate ply which lies directly behind said outer ply being detachable from the remainder of the said intermediate ply by perforations, the said remainder being secured by peripheral adhesive means to the said back ply forming a pocket, the said back ply having longitudinal weakening lines marking out 3 longitudinal panels therein, one of the said panels containing the said pocket, the other 2 of the said panels containing a duplicate copy by carbon or carbonless means of information entered on the face of the said outer ply.

2. A multiple-ply assembly according to claim 1 wherein the information entered on the said outer ply consists of a traveler's itinerary.

3. A multiple-ply assembly according to claim 1 or 2 wherein the said back ply may be folded along the said weakening lines to form a ticket-holding folder bearing a traveler's itinerary printed directly thereon.

4. A multiple-ply assembly according to claim 1 or 3 wherein a slit is formed in the said pocket-bearing panel creating a pocket for holding an airline boarding pass.

* * * * *